US006276286B1

(12) United States Patent
Williams et al.

(10) Patent No.: US 6,276,286 B1
(45) Date of Patent: Aug. 21, 2001

(54) COMPRESSION DEVICE FOR FEEDING A WASTE MATERIAL TO A REACTOR

(75) Inventors: Paul M. Williams, Lafayette; Kenneth M. Faller, Thornton; Edward J. Bauer, Denver, all of CO (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 09/684,657

(22) Filed: Oct. 10, 2000

(51) Int. Cl.[7] ..... F23K 3/14; F23G 5/02

(52) U.S. Cl. ..... 110/110; 110/223; 110/227; 110/228; 110/255; 110/257; 110/258; 110/259; 110/267; 110/293; 110/191; 110/101 R; 110/101 C; 110/169; 110/101 CF; 110/185

(58) Field of Search ..... 110/218, 219, 110/223, 227, 228, 255, 257, 258, 259, 267, 293, 341, 342, 348, 101 R, 110, 101 C, 101 CF, 185, 186, 191; 198/608; 414/187, 197; 241/260.1, 246, 247

(56) References Cited

U.S. PATENT DOCUMENTS 3,182,920 * 5/1965 Daniels ..... 241/282
3,319,587 * 5/1967 Albertson et al. ..... 110/8
4,315,468 * 2/1982 Tyer et al. ..... 110/101 CF
4,331,084 * 5/1982 Fitch et al. ..... 110/186
4,571,137 * 2/1986 Malmgren ..... 414/173
4,702,177 * 10/1987 Narisoko et al. ..... 110/110
4,781,796 * 11/1988 Bridle et al. ..... 202/117
5,088,422 * 2/1992 Koenig ..... 110/173 R
5,269,233 * 12/1993 Johnson et al. ..... 110/110
5,555,823 * 9/1996 Davenport ..... 110/346

* cited by examiner

*Primary Examiner*—Denise L. Ferensic
*Assistant Examiner*—K. B. Rinehart
(74) *Attorney, Agent, or Firm*—Dickson G. Kehl; Virginia B. Caress; Paul A. Gottlieb

(57) ABSTRACT

A compression device for feeding a waste material to a reactor includes a waste material feed assembly having a hopper, a supply tube and a compression tube. Each of the supply and compression tubes includes feed-inlet and feed-outlet ends. A feed-discharge valve assembly is located between the feed-outlet end of the compression tube and the reactor. A feed auger-screw extends axially in the supply tube between the feed-inlet and feed-outlet ends thereof. A compression auger-screw extends axially in the compression tube between the feed-inlet and feed-outlet ends thereof. The compression tube is sloped downwardly towards the reactor to drain fluid from the waste material to the reactor and is oriented at generally right angle to the supply tube such that the feed-outlet end of the supply tube is adjacent to the feed-inlet end of the compression tube. A programmable logic controller is provided for controlling the rotational speed of the feed and compression auger-screws for selectively varying the compression of the waste material and for overcoming jamming conditions within either the supply tube or the compression tube.

18 Claims, 3 Drawing Sheets

COMPRESSION DEVICE FOR FEEDING A WASTE MATERIAL TO A REACTOR

This invention was made with Government support under contract No. DE-AC04-90DP62349 awarded by the U.S. Department of Energy. The Government has certain rights in the invention.

FIELD AND HISTORICAL BACKGROUND OF THE INVENTION

The present invention is directed to waste material treatment devices, and more particularly to a compression device for feeding a waste material to a reactor.

Various reactor feed and waste treatment devices are currently available in the industry. U.S. Pat. No. 3,841,465 and 4,312,279 disclose reactor feed devices. These devices operate to produce a steady flow of material to the reactor, with varying methods of compaction. These conventional devices are not satisfactory, however, in that they are not versatile enough to process and adequately compress a wide range of waste materials. U.S. Pat. Nos. 4,915,308; 5,108,040 and 5,320,034 disclose waste treatment devices that utilize a compression auger-screw to shred and compact various waste forms for disposal and further processing. These conventional devices are also not satisfactory since they are commonly limited to a fixed compression ratio no greater than 3:1 and they possess no jamming prevention mechanism. Furthermore, none of the aforementioned devices adequately maintains an air-seal for use with the currently utilized thermal treatment reactors. U.S. Pat. No. 5,088,422 discloses a rotary isolation door for separating a waste stream feed from the reactor chamber. This single opening design produces excessive wear on the single annular cutting surface, requiring frequent loss of processing time for replacement. Additionally, it depends on relatively high-maintenance hydraulics for operation and does not have control mechanisms for precise operation.

In view of the various drawbacks associated with individual conventional devices, there is a need in the industry for a variable compression device to compress or compact a variety of waste feed materials and which is compatible with a conventional thermal treatment reactor. Furthermore, none of the aforementioned patents disclose or suggest the combination of elements or methods that are considered to make the present invention patentable, workable and advantageous for a compression device and feeder for a thermal treatment reactor.

OBJECTS AND BRIEF SUMMARY OF THE INVENTION

The principal object of the present invention is to provide a compression device for feeding a waste material to a reactor which has the capability to process various materials within a wide range of densities and compressibilities.

An object of the present invention is to provide a compression device for feeding a waste material to a reactor that could be used for the purpose of handling, treatment, or disposable of hazardous materials, radioactive waste, mixed waste, medical waste, municipal waste, and long-term stored waste.

Another object of the present invention is to provide a compression device for feeding a waste material to a reactor wherein the entire system creates a seal between the prepared waste and the thermal treatment reactor or system.

Yet another object of the present invention is to provide a compression device for feeding a waste material to a reactor which detects potential problems with the auger-screw assemblies prior to any occurrences and provides immediate, programmed corrective action. In particular, the device of the present invention includes a logic component that, upon detection of a jamming condition of the auger-screw assemblies, alerts the operator and follows a series of corrective sequences to eliminate the jamming condition—shutting-down the device only when absolutely necessary. This arrangement reduces the frequency of downtime and the necessity of the operator-interference thereby significantly reducing the efforts on the part of the operator.

An additional object of the present invention is to provide a compression device for feeding a waste material to a reactor which is highly reliable in that it monitors and controls rotational speeds and rotational directions of both the feed and compaction auger-screws thereby preventing a jamming condition well in advance of its occurrence.

Another additional object of the present invention is to provide a compression device for feeding a waste material to a reactor that is easy to disassemble for cleaning, repair and maintenance.

Yet an additional object of the present invention is to provide a compression device for feeding a waste material to a reactor which is self-draining towards the reactor for any liquid component in the waste material.

Still yet an additional object of the present invention is to provide a compression device for feeding a waste material to a reactor in which the feed auger-screw and the compression auger-screw are arranged at right angles to each other to thereby prevent any stress concentrations on the initial flight of the compression auger-screw.

Still yet an additional object of the present invention is to provide a compression device for feeding a waste material to a reactor which can be completely isolated from the reactor by closing the shut-off valve and disassembling the flange joint therebetween. This arrangement allows the reactor to continue its operation during maintenance on the compression device.

A further object of the present invention is to provide a compression device for feeding a waste material to a reactor which has the capability of reaching a compressional ratio of over 5:1.

Yet a further object of the present invention is to provide a compression device for feeding a waste material to a reactor which utilizes the fill cutting surfaces of all the shear-cutting ports in clockwise and counter-clockwise directions. This arrangement substantially increases longevity of the shear-cutting surfaces and significantly reduces repair and maintenance.

Still yet a further object of the present invention is to provide a compression device for feeding a waste material to a reactor in which the feed-discharge gate valve is automatically closed by a programmable logic controller (PLC) via an electrical interlock.

Still yet a further object of the present invention is to provide a compression device for feeding a waste material to a reactor in which the feed-discharge gate valve provides positive gas sealing in the event compacted waste sealing is not available, to thereby prevent reactor gases from flowing back into the hopper and possibly out of the device where they may be hazardous to the operating personnel.

Yet an additional object of the present invention is to provide a compression device for feeding a waste material to a reactor which, in the event of a catastrophic tight jamming of an auger-screw, allows for easy removal of the total auger-screw assembly. This relieves the jam, allows for replacement of an auger-screw, if necessary, and allows for a thorough cleaning of all internal areas. The overall end result is that the production downtime is significantly reduced.

Still yet an additional object of the present invention is to provide a compression device for feeding a waste material to a reactor which satisfies nuclear safety considerations of requiring the maintenance personnel to perform various servicing operations utilizing gloves through glovebox ports.

In accordance with the present invention, a compression device for feeding a waste material to a reactor includes a waste material feed assembly having a hopper, a supply tube and a compression tube. Each of the supply and compression tubes includes feed-inlet and feed-outlet ends. A feed-discharge valve assembly is located between the feed-outlet end of the compression tube and the reactor. A feed auger-screw extends axially in the supply tube between the feed-inlet and feed-outlet ends thereof A compression auger-screw extends axially in the compression tube between the feed-inlet and feed-outlet ends thereof The compression tube is sloped downwardly towards the reactor to drain fluid from the waste material to the reactor and is oriented at generally right angle to the supply tube such that the feed-outlet end of the supply tube is adjacent to the feed-inlet end of the compression tube. A programmable logic controller is provided for controlling the rotational speed of the feed and compression auger-screws for selectively varying the waste material feed and the compression of the waste material.

BRIEF DESCRIPTION OF THE DRAWINGS

The above and other objects, novel features and advantages of the present invention will become apparent from the following detailed description of the invention as illustrated in the accompanying drawings in which.

DETAILED DESCRIPTION OF THE INVENTION

Figure 1:
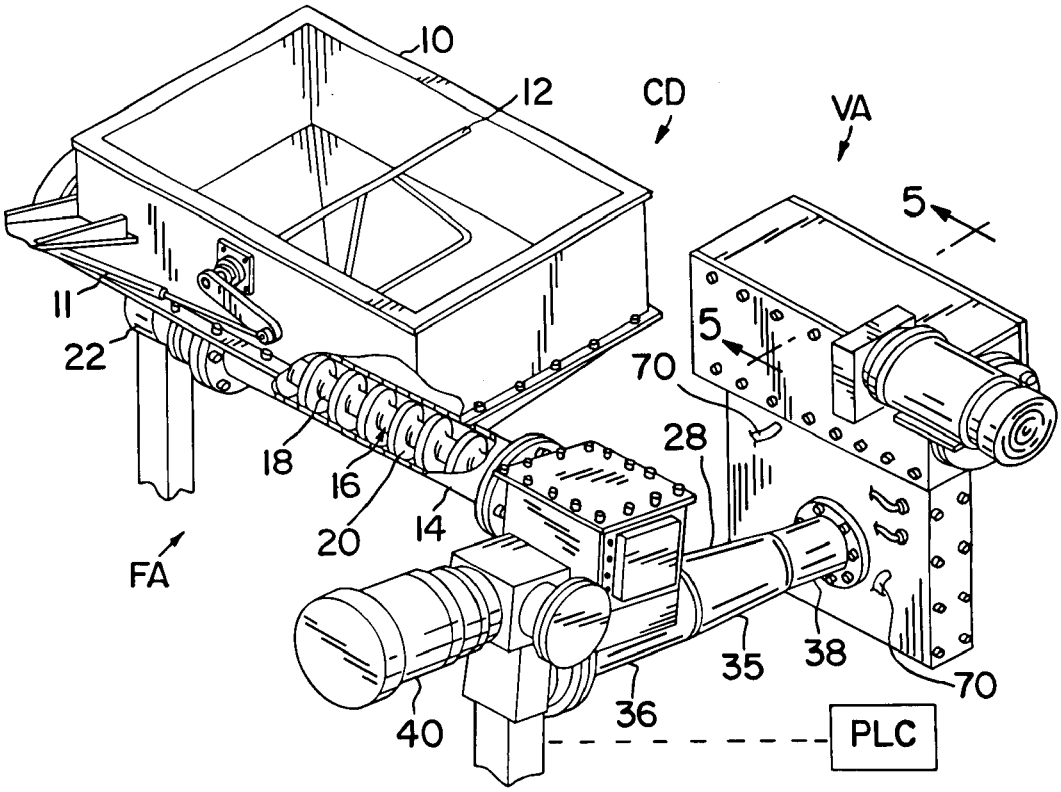
FIG. 1 is a perspective view of the compression device of the present invention.

As best shown in FIG. 1, the compression device CD of the present invention includes three main components, namely: a waste material feed assembly FA, a programmable logic, control PLC, and a valve assembly VA.

The feed assembly FA includes a hopper 10 provided with an agitator 12 for loosening-up the waste material. A supply housing or tube 14 is provided to receive by gravity, the waste material from hopper 10. A feed auger-screw 16 extends axially within the supply tube 14. The feed auger-screw 16 includes a substantially constant core 18 and a flighting 20 of a substantially constant height. The auger-screw 16 also has a constant pitch to supply or meter the waste material to the compression tube 28 at a consistent and controlled rate. A drive motor 22 is provided for rotating the feed auger-screw 16. In FIG. 1, reference numeral 11 designates a mechanism for actuating the agitator 12.

Figure 4:
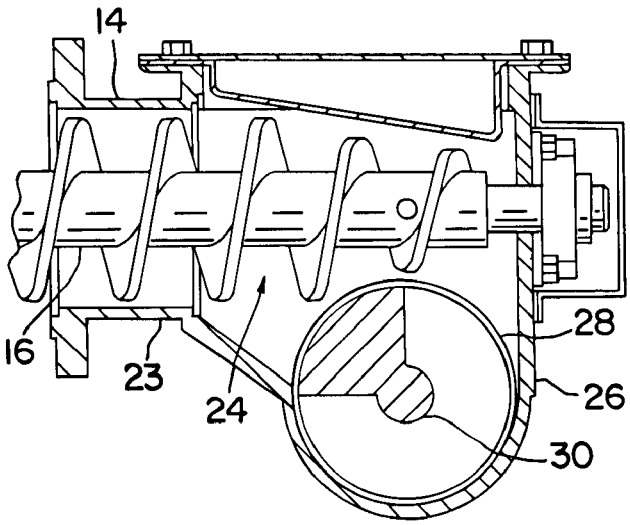
FIG. 4 is a partial, enlarged sectional view taken along line 4—4 of FIG. 2.

As best shown in FIG. 4, end portion 24 of the auger-screw 16, adjacent the feed outlet end 23 of the tube 14, has a somewhat decreased height flighting in order to push the waste material down towards the inlet end 26 of the compression tube 28.

Figure 2:
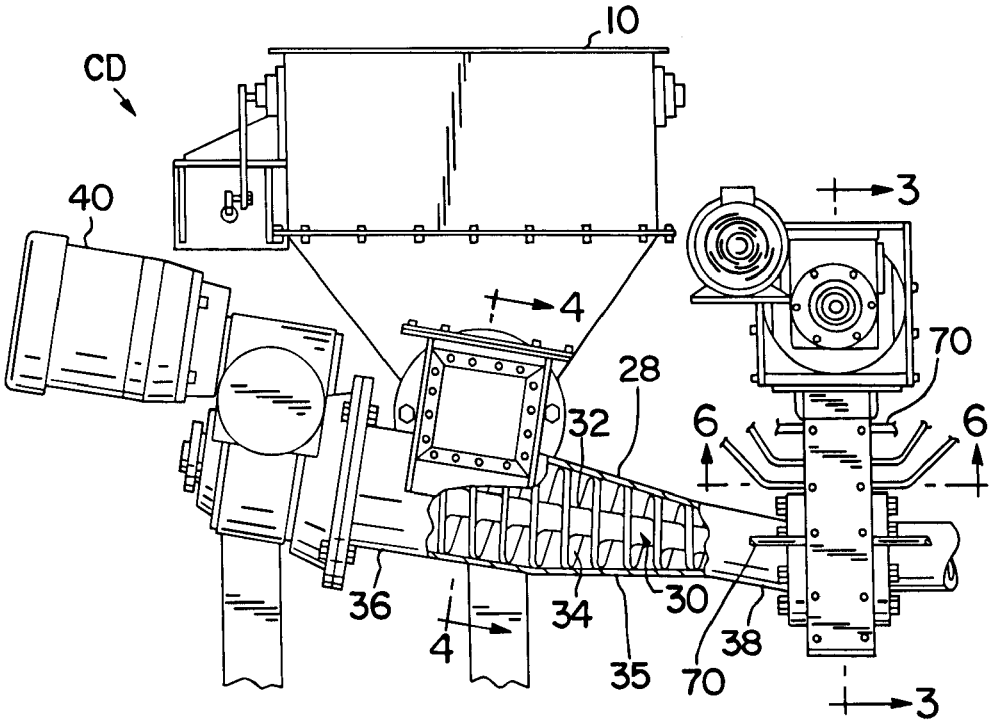
FIG. 2 is a side elevational view of the device shown in FIG. 1.

As best shown in FIG. 2, a compression auger-screw 30 extends axially within the compression tube 28. The auger-screw 30 also preferably includes a constant core 32, and a flighting 34 the height of which, however, decreases from the feed-inlet end 36 towards the feed-outlet end 38 of the compression tube 28. A drive motor 40 is provided for rotating the compression auger-screw 30.

Figure 3:
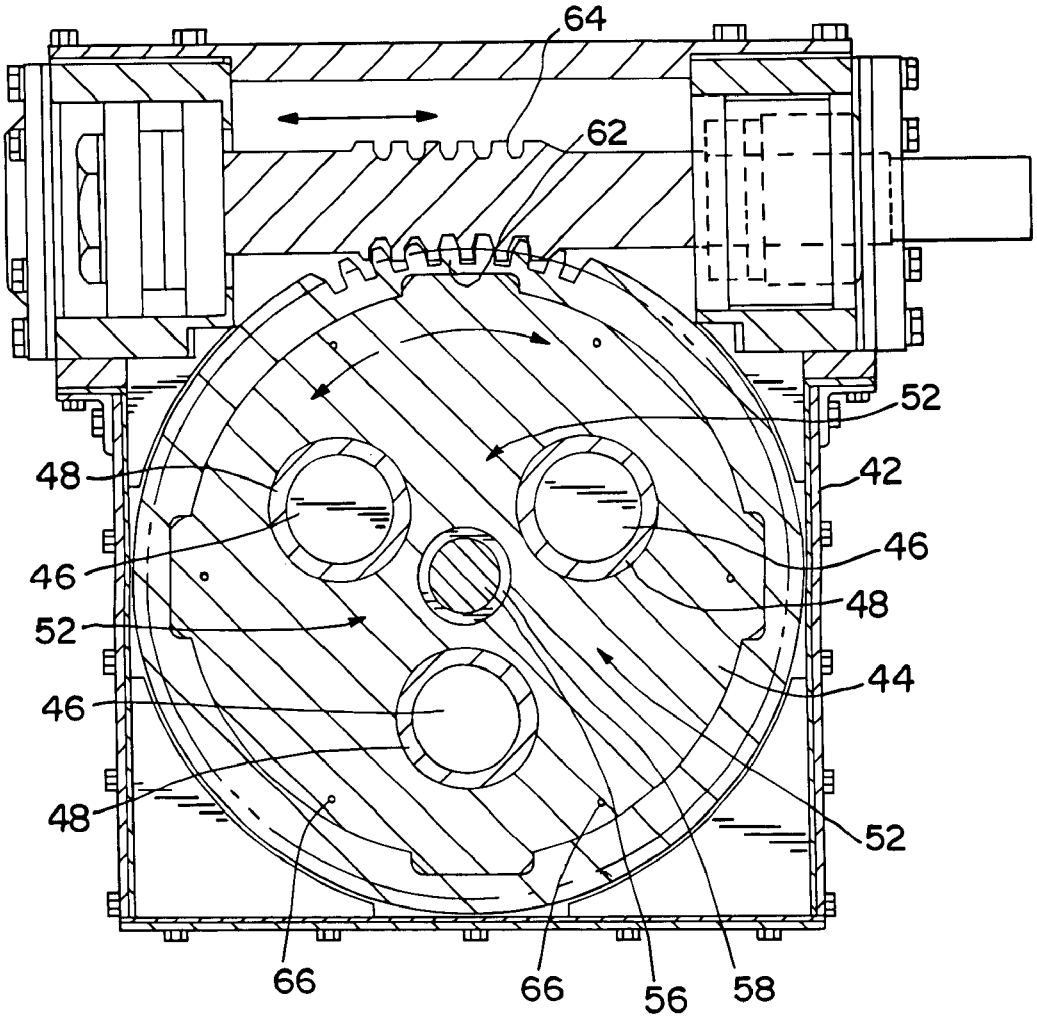
FIG. 3 is an enlarged sectional view taken along line 3—3 of FIG. 2.
Figure 5:
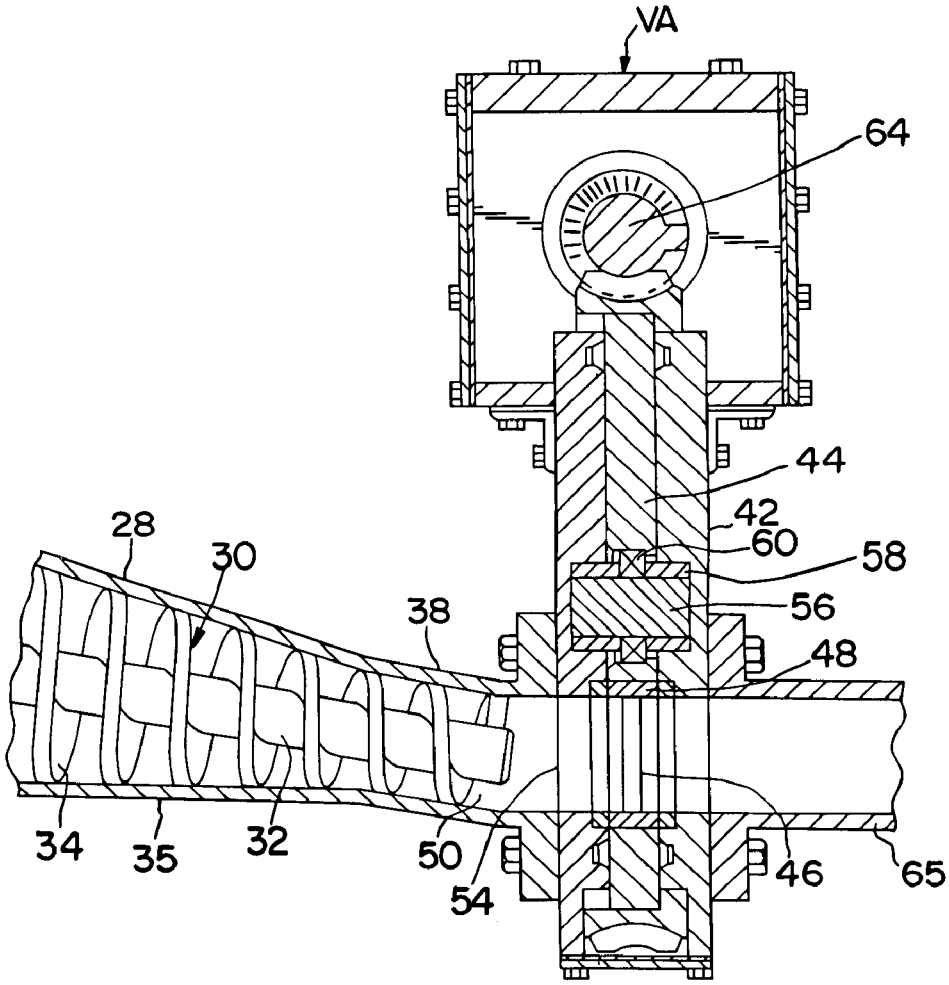
FIG. 5 is an enlarged sectional view taken along line 5—5 of FIG. 1.

As best shown in FIGS. 3 and 5, the feed-outlet end 38 of the compression tube 28 is connected to the valve assembly VA. The valve assembly VA includes a valve housing 42 that accommodates therein a rotatable guillotine valve member 44 provided with preferably three shear-cutting ports 46. As best shown in FIG. 3, the shear-cutting ports 46 are arranged in a generally circular pattern angularly spaced at about 120° from each other. (It is noted herewith that the number and configuration of the shear-cutting ports may be varied, as desired. For example, it may be practical to provide six to nine, or more shear-cutting ports).

As best shown in FIGS. 3 and 5, the valve member 44 is supported on a center shaft 56, a bushing 58 and a precision roller bearing 60. Preferably, the valve member 44 includes a worm gear 62 in engagement with a worm gear 64 of a drive system. Each of the shear-cutting ports 46 includes a cutting blade member 48 provided at the internal periphery thereof.

As can be seen in relation to FIGS. 3 and 5, only one of the shear-cutting ports 46 would be in alignment with the interior 50 of the compression tube 28. In particular, the shear-cutting port 46, shown positioned at a six o'clock position in FIG. 3, would be in alignment with the interior 50 of tube 28. By rotating the valve member 44 clockwise or counter-clockwise, the other two shear-cutting ports 46 may also be individually brought in alignment with interior 50 of tube 28. One of ordinary skill in the art would appreciate that by aligning the portion 52 of the valve member 44 that lies between the ports 46, the opening 54 to the compression tube 28 may be completely closed. In particular, starting from an open position, by rotating the valve member forty-five to sixty degrees in a clockwise or a counter-clockwise direction, the opening 54 of the compression tube 28 may be completely closed.

In FIG. 5, the reference numeral 65 designates a conduit feeding to a thermal reactor (not shown).

Figure 6:
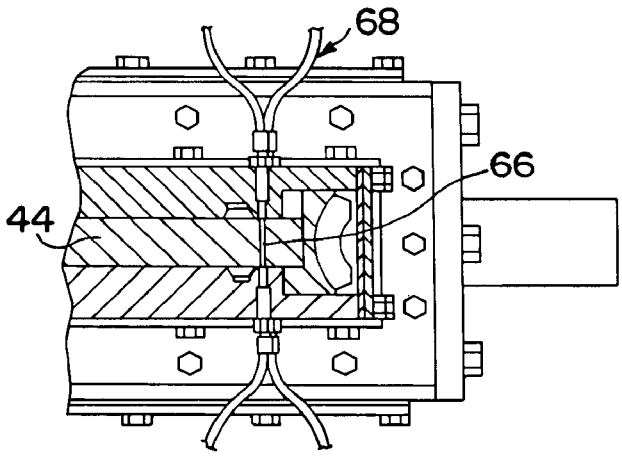
FIG. 6 is an enlarged sectional view taken along line 6—6 of FIG. 2.

As best shown in FIGS. 3 and 6, the valve member 44 is provided with minute peripheral holes 66 that cooperate with a photosensor mechanism 68 to determine and control the position of the shear-cutting ports 46 relative to the compression tube 28.

As shown in FIGS. 1 and 2, the valve assembly VA is provided with ports 70 for the operation of an inflatable combination pneumatic seal/cooling system 72 (best shown in FIG. 6). These seals 72 are embedded radially in both sides of the valve member 44. When inflated the seals 72 touch the machined surfaces of valve member 44. The pneumatic seal/cooling system 72 operates by pressuring the seal with air or nitrogen, but allows a continuous flow of the gas in order to keep the seal surfaces within the acceptably safe temperature boundaries of the selected seal material.

USE AND OPERATION

In use, the waste material is placed in the hopper 10 and the agitator 12 is actuated. The waste material is received in the supply tube 14 by gravity and is conveyed uncompressed to its feed-outlet end 23 where it is forced out into the compression tube 28 (FIG. 4). It is noted that the feed auger-screw 16 is dedicated to the metered supply of the waste material to the compression auger-screw 30.

The compression auger-screw 30 receives the waste material which is initially conveyed uncompressed until it reaches the conical-shaped compression section 35 adjacent the feed-outlet end 38 (FIG. 2). The waste material continues to fill the compression section 35 and is eventually compressed preferably to a 5:1 compression ratio. The compressed waste lodged in the compression section 35 also provides a gas pressure seal. The rotational sped of the feed auger-screw 16 is controlled by the PLC and may be programmably tied to the reactor chamber exit temperature. For example, as the exit temperature decreases, the PLC increases the rotational speed of the feed auger-screw 16. As a result, the waste is fed at a higher rate and the additional incinerated waste produces the additional heat required. As such, a lower exit temperature results in an increased feed auger-screw 16 speed, while a higher temperature exit results in a decreased feed auger-screw 16 speed.

Both the feed auger-screw 16 and the compression auger-screw 30 are electrically connected to the PLC that independently controls the variable speed drive motors 22 and 40, respectively. Normal operation is obtained when both the feed auger-screw 16 and the compression auger-screw 30 turn at a set speed ratio. To increase compression ratio of the feed the compression auger-screw 30 is slowed in relation to the feed auger-screw 16. Conversing, when a decrease in compression is desired the compression auger-screw 30 speed is increased in relation to the feed auger-screw 16.

The PLC is programmed to detect potential problems within the auger-screws prior to any occurrences and provides immediate corrective action when necessary. The PLC receives electrical input data from the drive motors 22 and 40 (such as current and RPM) to determine resistive torque values. In the event of a jamming condition, one or more of the following sequences is followed:

i) When a first (programmed allowable) high resistance torque value is reached in the compression auger-screw 30, operating personnel are alerted and notified of this event by the PLC. At this point, the PLC automatically increases the rotational speed of the compression auger-screw 30 which, in due course, relieves waste compression, reduces torque resistance and subsequently allows for the resumption of normal operation.

ii) When a second (programmed allowable) higher resistance torque value is reached in the compression auger-screw 30, the PLC reduces the rotational speed of the feed auger-screw 16. This action reduces the amount of waste entering the compression tube 28 and ultimately relieves waste compression, reduces torque resistance and should subsequently allow for the resumption of normal uninterrupted operation.

iii) When the third (programmed allowable) highest resistance torque value is reached in the compression auger-screw 30, the PLC automatically stops the feed auger-screw 16 and initiates an unjamming routine, i.e., a reverse/forward rotation (cycling mode) of the auger-screw 30. The cycling mode continues until the resistance torque value is reduced to below the first (programmed allowable) resistance torque value, or until a preset number of cycles have been completed. If the programmed lower torque-resistance value is attained in the compression auger-screw 30, then both the feed auger-screw 16 and the compression auger-screw 30 resume normal-forward rotation and normal operation. If the unjamming routine (cycling mode) fails to sufficiently reduce the resistive torque within the preset number of cycles, the PLC sounds an alarm alerting operating personnel and, after an appropriate time delay, shuts down the compression auger-screw 30 then closes and seals the isolation valve assemble VA between the compression device CD and the thermal reactor.

iv) Similarly, in the unlikely event of a separate (programmed allowable) highest resistance torque value being reached in the feed auger-screw 16, the PLC automatically stops the compression auger-screw 30 and initiates an unjarming routine, i.e., a reverse/forward rotation (cycling mode) of the feed auger-screw 16. Similarly, the cycling mode continues until the resistance torque value is sufficiently reduced, or until a preset number of cycles have been completed. If the programmed lower torque-resistance value is attained in the feed auger-screw 16, then both the feed auger-screw 16 and the compression auger-screw 30 resume normal-forward rotation and normal operation. If the unjamming routine (cycling mode) fails to sufficiently reduce the resistive torque within the preset number of cycles, the PLC sounds an alarm alerting operating personnel and, after an appropriate time delay, shuts down the feed auger-screw 16 then closes and seals the isolation valve assemble VA between the compression device CD and the thermal reactor.

The compression device CD of the invention has been successfully operated to process polypropylene pellets, shredded paper and plastics, wood chips, and PVC sheet material.

While this invention has been described as having preferred ranges, steps, materials, or designs, it is understood that it is capable of further modifications, uses and/or adaptations of the invention following in general the principle of the invention, and including such departures from the present disclosure, as those come within the known or customary practice in the art to which the invention pertains and as may be applied to the central features hereinbefore set forth, and fall within the scope of the invention and of the appended claims.

What is claimed is:

1. A compression device for feeding a waste material to a reactor, comprising:

(a) a waste material feed assembly including a hopper, a supply tube, and a compression tube;

(b) each of said supply and compression tubes including feed-inlet and feed-outlet ends;

(c) a feed-discharge assembly located between the feed-outlet end of said compression tube and the reactor;

(d) a feed auger-screw extending axially in said supply tube between the feed-inlet and feed-outlet ends thereof;

(e) a compression auger-screw extending axially in said compression tube between the feed-inlet and feed-outlet ends thereof;

(f) said supply and compression tubes being oriented at generally a right angle to each other such that the feed-outlet end of said supply tube is adjacent the feed-inlet end of said compression tube;

(g) said compression tube being sloped downwardly towards the reactor to drain fluid from the waste material to the reactor; and (h) a logic means for controlling the rotational speed and rotational direction of said feed and compression auger-screws.

2. The compression device of claim 1, wherein:

(a) said feed discharge assembly includes an isolation gate valve; and (b) said gate valve comprises a rotatable member with a plurality of feed discharge ports.

3. The compression device of claim 2, wherein:

each of said feed discharge ports comprises a shear-cutting port having a blade member disposed about the internal circumference of the respective port.

4. The compression device of claim 3, wherein:

(a) said rotatable member comprises a generally round worm-gear disc member; and (b) said shear-cutting ports are arranged in a circular pattern.

5. The compression device of claim 4, further comprising:

(a) a drive system for rotating said worm-gear disc member in a clockwise or counter-clockwise direction; and (b) wherein the waste material may be discharged to the reactor by selectively aligning one of said shear-cutting ports with the interior of said compression tube.

6. The compression device of claim 1, wherein:

(a) said feed auger-screw comprises a core portion and a flight portion; and (b) said flight portion comprises a generally constant flight height.

7. The compression device of claim 1, wherein:

(a) said compression auger-screw comprises a core portion and a flight portion; and (b) the height of said flight portion decreases from the feed-inlet end to the feed-outlet end of said compression tube.

8. The compression device of claim 7, wherein:

the height of said flight portion of said compression auger-screw is selected so as to produce a compression ratio of equal to or more than 5:1.

9. The compression device of claim 8, wherein:

said compression ratio is variable.

10. The compression device of claim 1, further comprising:

an agitator operably connected to said hopper for agitating the waste material.

11. The compression device of claim 1, further comprising:

(a) drive means operably connected to said logic means for independently rotating said feed and compression auger-screws;

(b) said logic means including means for detecting a torque-resistance from said drive means; and (c) said logic means preventing a jamming condition of one or both of said feed and compression auger-screws by selectively varying the rotational speeds and rotational directions of said feed and compression auger-screws.

12. A compression device for feeding a waste material to a reactor, comprising:

(a) a waste material feed assembly including a hopper with an agitator, a supply tube, and a compression tube;

(b) each of said supply and compression tubes including feed-inlet and feed-outlet ends;

(c) a feed-discharge gate valve located between the feed-outlet end of said compression tube and the reactor;

(d) a feed auger-screw having a substantially constant flight-height extending axially in said supply tube between the feed-inlet and feed-outlet ends thereof;

(e) a compression auger-screw having a variable flight-height extending axially in said compression tube between the feed-inlet and feed-outlet ends thereof;

(f) said supply and compression tubes being oriented at generally a right angle to each other such that the feed-outlet end of said supply tube is adjacent the feed-inlet end of said compression tube;

(g) said compression tube being sloped downwardly towards the reactor to drain fluid from the waste material to the reactor;

(h) said feed-discharge gate valve comprising a rotatable guillotine valve member with a plurality of shear-cutting ports arranged in a generally circular pattern therein;

(i) means for selectively rotating said guillotine valve member in a clockwise or a counter-clockwise direction; and (j) a logic means for controlling the rotational speed and direction of said feed and compression auger-screws.

13. The compression device of claim 12, wherein:

said shear-cutting ports are arranged at an angle of about 120° from each other.

14. The compression device of claim 12, wherein:

said shear cutting ports are accurately aligned by use of at least one photoelectric sensor.

15. The compression device of claim 12, wherein:

said feed-discharge gate valve can be sealed by means of pneumatics.

16. The compression device of claim 12, wherein:

the flight-height of said compression auger-screw decreases from the feed-inlet end to the feed-outlet end of said compression tube.

17. The compression device of claim 16 wherein:

said compression auger-screw produces a compression ratio of equal to or more than 5:1.

18. The compression device of claim 12, further comprising:

(a) drive means operably connected to said logic means for independently rotating said feed and compression auger-screws;

(b) said logic means including means for detecting a torque-resistance from said drive means; and (c) said logic means preventing a jamming condition of one or both of said feed and compression auger-screws by selectively varying the rotational speeds and rotational direction of said feed and compression auger-screws.

* * * * *